United States Patent [19]

Müller

[11] 4,166,480

[45] Sep. 4, 1979

[54] APPARATUS FOR FORMING LENO SELVEDGES IN WEAVING MACHINES

[75] Inventor: Walter Müller, Tann-Rüti, Switzerland

[73] Assignee: Rüti Machinery Works Limited, Rüti, Switzerland

[21] Appl. No.: 901,252

[22] Filed: Apr. 28, 1978

[30] Foreign Application Priority Data

May 13, 1977 [CH] Switzerland ..... 5995/77

[51] Int. Cl.[2] ..... D03C 11/00; D03D 47/40

[52] U.S. Cl. ..... 139/54

[58] Field of Search ..... 139/48, 54, 430

[56] References Cited

U.S. PATENT DOCUMENTS

| | | | |
|---|---|---|---|
| 2,399,880 | 5/1946 | Moessinger | 139/54 |
| 3,320,978 | 5/1967 | Kobayashi | 139/54 |
| 3,945,406 | 3/1976 | Wueger | 139/54 |
| 3,998,247 | 12/1976 | Kovar | 139/54 |

*Primary Examiner*—Henry Jaudon

*Attorney, Agent, or Firm*—Werner W. Kleeman

[57] ABSTRACT

An apparatus for forming leno selvedges in weaving machines, comprising a stationary sun wheel and two diametrically arranged planet wheels connected therewith and rotatable about their own axis in an opposite direction to their direction of rotation about the axis of the sun wheel. The transmission ratio between the sun wheel and the planet wheels amounts to 2:1. There are provided bobbin holders for thread bobbins. Thread guide eyelets are arranged on the planet wheels eccentrically with respect to the axes of the planet wheels. These thread guide eyelets, when at their greatest spacing from one another, are situated in a plane extending through the central axis of the planet wheels. The bobbin holders are fixedly arranged on a part which supports the planet wheels.

8 Claims, 2 Drawing Figures

APPARATUS FOR FORMING LENO SELVEDGES IN WEAVING MACHINES

BACKGROUND OF THE INVENTION

The present invention broadly relates to the art of selvedge braiding, and, more specifically, is directed to a new and improved construction of apparatus for forming leno selvedges in weaving machines or looms.

Generally speaking, the apparatus of the present invention is of the type having a stationary sun wheel and two planet wheels which are connected therewith, diametrically arranged, and capable of rotating about their own rotational axis in a direction opposite to their direction of rotation about the rotational axis of the sun wheel. The transmission ratio between the sun wheel and the planet or planetary wheels amounts to 2:1. Bobbin holders for thread bobbins are provided. Also, there are arranged on the planet wheels thread guide eyelets eccentrically with respect to the axes of the planet wheels. These thread guide eyelets, when dispositioned at their greatest spacing from one another, are situated in a plane extending essentially through the central axis of the planet wheels.

Now selvedge braiding apparatus of this general construction is already known to the art from U.S. Pat. No. 3,320,978, granted May 23, 1967. In that prior art construction the thread bobbins are secured on the planet wheels and participate in the circulatory and rotational movement thereof. Since the thread bobbins only can be relatively small, by virtue of the fact that they are secured on the planet wheels or gears, their yarn or thread supply is quickly exhausted. This in turn requires rapid successive changes of the thread bobbins. Also, by virtue of the aforementioned attachment of the thread bobbins at the planet wheels, the construction of the entire apparatus is constricted in a manner such that there is no possibility of arranging any thread monitoring elements on the apparatus.

SUMMARY OF THE INVENTION

Hence, with the foregoing in mind, it is a primary object of the present invention to provide a new and improved construction of apparatus for forming leno selvedges in weaving machines in a manner not associated with the aforementioned drawbacks and limitations of the prior art equipment discussed above.

Another and more specific object of the present invention aims at providing an apparatus for forming leno selvedges which, on the one hand, enables use of relatively large thread bobbins and, on the other hand, arrangement of thread monitoring elements at the apparatus.

Yet a further significant object of the present invention is to render more efficient the operation of leno selvedge forming apparatus of the character described, particularly by increasing the available supply of yarn or thread payed-off the thread bobbins, beneficially reducing the frequency of the thread bobbin change operations required for the exhausted thread or yarn supply, while further enhancing operation of the apparatus by enabling incorporation therein of a monitoring function for the thread or the yarn.

Now in order to implement these and still further objects of the invention, which will become more readily apparent as the description proceeds, an important feature of the present invention contemplates fixedly securing the bobbin holders to a part which supports the planet wheels or gears.

According to one particularly advantageous construction, this part which supports the planet wheels may be formed as a supporting disk capable of being driven. With this arrangement the planet wheels and the bobbin holders are disposed at different sides of the supporting disk.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
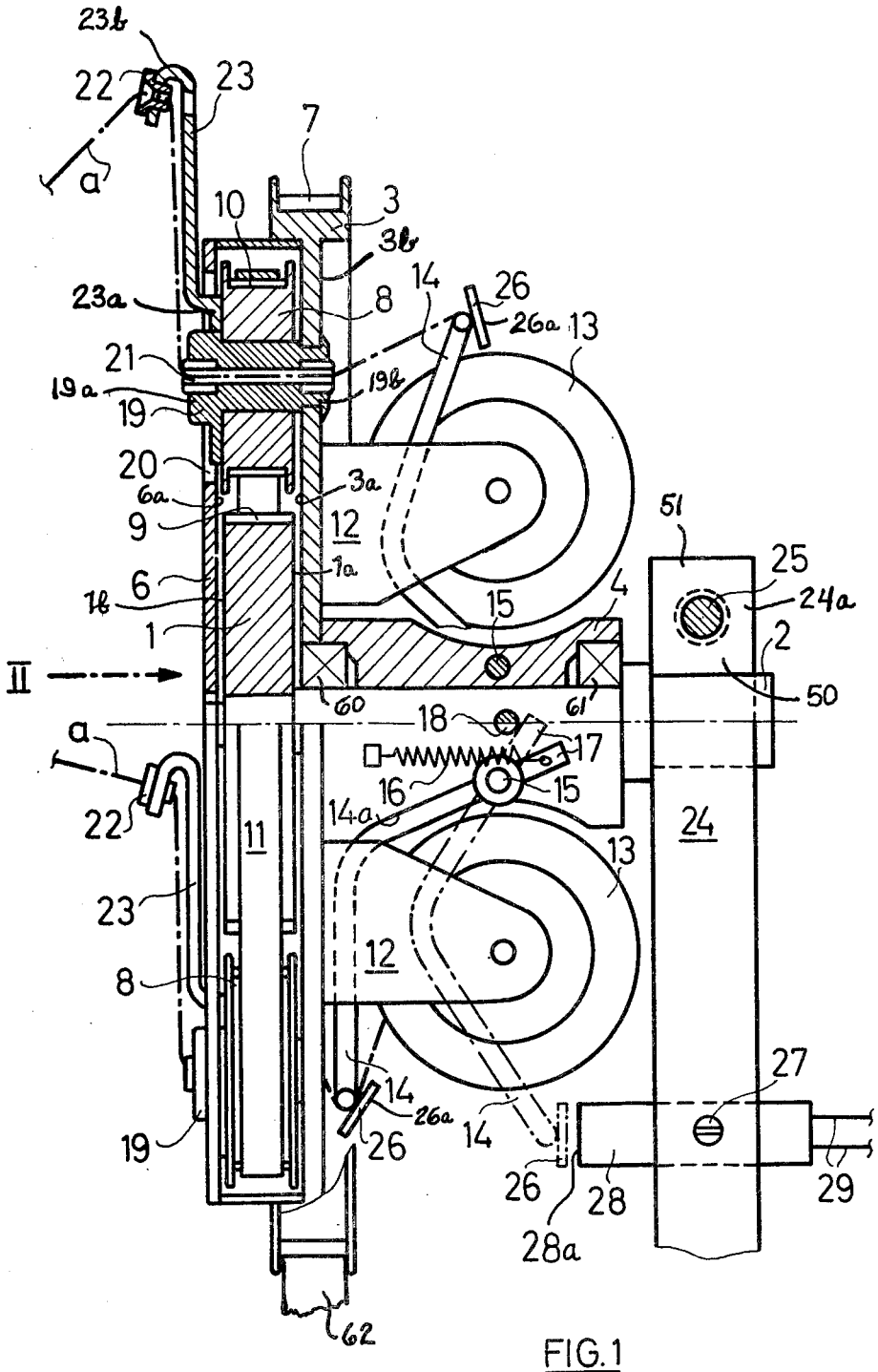
FIG. 1 is a side view, partially in section, of an exemplary embodiment of apparatus for forming leno selvedges.
Figure 2:
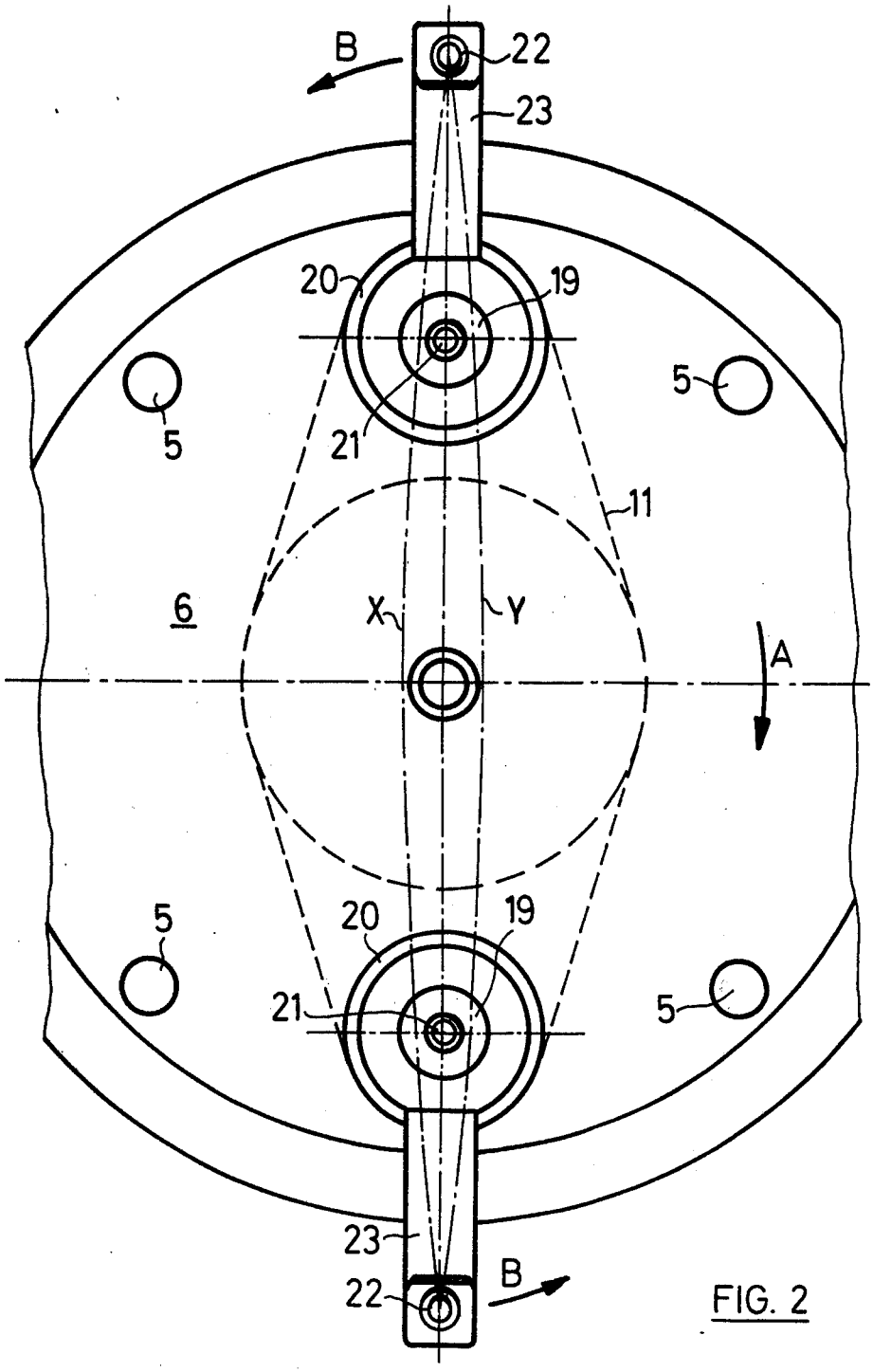
FIG. 2 is an end view of the apparatus shown in FIG. 1, looking in the direction of the arrow II thereof.

Describing now the drawings, it is to be understood that to simplify the illustration details of the construction of the loom with which the selvedge forming apparatus is used have not been shown, especially, inasmuch as the same are unimportant for understanding the underlying concepts of the present invention, apart from the fact that such construction is known to those skilled in the art and therefore need not here be further considered beyond any disclosure thereof made herein. Turning attention now to FIGS. 1 and 2, it will be seen that a sun wheel 1 or equivalent structure is securely mounted on a shaft 2. The shaft 2 is supported by an arm 24 secured on the not particularly illustrated machine frame. The arm 24, at its end 24*a* which supports the shaft 2, is constructed as a clamping strap or bracket 50 whose two clamping jaws, generally indicated by reference character 51, are held or clamped together by a suitable fixing element, here shown as a threaded screw or bolt 25. The manner in which the arm 24 is secured to the machine frame has not been shown, since this is not crucial to the invention, but, purely by way of example, may be accomplished in the manner disclosed for instance in the aforementioned U.S. Pat. No. 3,320,978, to which reference may be readily had and the disclosure of which is incorporated herein by reference. A supporting disk 3 is arranged at one side 1*a* of the sun wheel 1 and is rotatably mounted by bearing means 60 on the shaft 2. A member 4, here shown as a prismatic member, is securely connected in any desired manner with such supporting disk 3. This prismatic member 4 likewise is rotatably seated by the bearing means 60 and 61 upon the shaft 2. At the other side 1*b* of the sun wheel 1 there is arranged a cover plate 6 which is fixedly connected with the supporting disk 3 by any suitable fixing expedients, such as the here shown spacer screws or bolts 5.

Continuing, it is to be observed from the showing of FIG. 1 that the supporting disk 3 is provided at its circumference with a system of teeth 7 intended to engage with a conventional driving toothed belt, only partially schematically indicated by reference character 62 in FIG. 1. Rotatably mounted on the driven supporting disk 3 are two diametrically arranged planet wheels 8 or equivalent structure—also referred to in the art as planetary wheels—which extend from the face or side 3*a* of the supporting disk 3 towards the face or side 6a of the oppositely situated cover plate 6. It is further to be recognized that these planet wheels 8 are situated diametrically opposite one another to opposed sides of the sun wheel 1 and in a common plane with respect thereto. The sun wheel 1 is provided with teeth or a tooth system 9, and equally, the planet wheels 8 are provided with teeth or a tooth system 10. The transmission ratio between the sun wheel 1 and the planet wheels 8 amounts to 2:1.

Trained around both the sun wheel 1 and the planet wheels 8 is a common drive element, in this case a common toothed belt 11, so that whenever there is accomplished rotational movement of the supporting disk 3, and thus, rotational movement of the planet wheels 8 about the sun wheel 1, there is imparted to the planet wheels 8 a rotational movement about their own respective axis of rotation. Equally, it will be apparent that the rotational movement of the planet wheels 8 about their own axis is in the opposite direction to their direction of rotation about the sun wheel 1. During operation of the equipment, the supporting disk 3 rotates by way of example in the direction of the arrow A and the planet wheels 8 rotate about their own axis in the direction of the arrow B.

Now at that side or face 3b of the supporting disk 3 which is remote from the sun wheel 1 there are fixedly arranged two bobbin holders 12 intended for supporting thread or yarn bobbins 13, hereinafter conveniently simply referred to as thread bobbins. Quite obviously, any suitable technique may be used for fixing the two bobbin holders 12 to the supporting disk 3, there being mentioned for instance the use of standard fastening devices, such as screws, bolts or equivalent structure, as well as also welding or other bonding techniques well known for such purpose. A curved or bent arm 14, serving for thread monitoring as will be explained more fully hereinafter, extends about its related thread bobbin 13, and one such curved arm 14 is operatively associated with each bobbin holder 12. These thread monitoring arms 14 are pivotably mounted by pivot pins 15 on the prismatic member 4. Each of these arms 14 can be rocked away, under the force of a tension spring 16 or equivalent or other suitable structure, from the supporting disk 3 at their portion 14a which extends about the related thread bobbin 13. The amplitude of such pivoting or rocking movement is limited by a suitable stop or abutment pin 18 which protrudes into the zone or range of pivoting of the stub end 17 of the curved or flexed arms 14. Each free or stub end 17 of the thread monitoring or curved arms 14 project beyond the associated pivot pin 15. The abutment pins or stops 18 are also attached to the prismatic member 4.

Further, it will be observed that the planet wheels 8 are securely mounted on hubs 19 which are rotatably mounted in the supporting disk 3. These hubs 19 project at the one respective end 19a thereof into corresponding recesses or openings 20 of the covering or cover plate 6. Each hub 19 is provided with a continuous or through longitudinal bore 21 extending between the hub end 19a and the opposite situated hub end 19b, as best seen by referring to FIG. 1. Securely mounted on the end 19a of each hub 19 which projects into its associated recess 20 is one end 23a of a related arm 23 which, at its other end 23b, supports a thread guide eyelet 22 or equivalent structure. These thread guide eyelets 22 of the arms 23, during operation of the apparatus, move along arcuate paths of travel X and Y with a large radius.

The thread a, which is to be drawn-off each thread bobbin 13, is guided over its related thread monitoring arm 14 and through the bore 21 of the associated hub 19 to the respective thread guide eyelet 22, and then extends from the latter to the fell of the cloth. The thread tension swings or rocks the related arm 14, in opposition to the force exerted by the associated spring 16, into a position which, owing to the varying thread tension, is between the two pivoted positions each shown in full lines in the lower and upper half of the showing of FIG. 1 respectively. Now if a thread a breaks, then the spring 16 of the associated thread monitoring arm 14 rocks the latter into the position shown in dot-dash or phantom lines in the lower half of the illustration of FIG. 1.

Each arm 14 is provided with an element 26 in the form of a small plate 26a. Operatively associated with each such plate 26a is a suitable response member, here shown as a proximity switch 28 fixed on the arm 24, as for instance by a screw or threaded bolt 27 or the like. This proximity switch 28, connected by means of the lines or conductors 29 with any suitable and conventional stopping or shutdown mechanism for the weaving machine or loom, is activated, as is well known, owing to changes in the inductance brought about when the relevant plate element 26a at the thread monitor arm 14 of which there has been detected thread breakage approaches the proximity switch 28 at a specific minimum distance, for instance with a spacing of about 3 millimeters between such plate element 26 and the confronting surface 28a of the proximity switch 28. The position of the proximity switch 28 on the arm 24 is beneficially selected such that the proximity switch 28 is situated along the circular path of movement of the plate elements 26 in the pivoted position of the arms 14 shown in phantom lines. Thus, if a thread a breaks and the related thread monitoring arm 14 together with its plate element 26 arrives at the pivoted position shown in dot-dash or phantom lines in FIG. 1, then during the next rotation of this plate element 26 past the proximity switch 28 the latter will be actuated, and accordingly, the machine is stopped by means of a suitable response or control signal emitted by the proximity switch 28 and delivered via the lines 29 to the loom stopping mechanism.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for forming leno selvedges in weaving machines, comprising:

a stationary sun wheel having an axis;

two diametrically arranged planet wheels cooperating with said sun wheel;

each of said diametrically arranged planet wheels having an axis of rotation;

means for operatively coacting said two planet wheels with said sun wheel;

means supporting said planet wheels to be rotatable about their own axis in a direction opposite to their direction of rotation about the axis of the sun wheel;

means for driving said planet wheels about the axis of the sun wheel and about their own respective axis of rotation;

the transmission ratio between the sun wheel and the planet wheels amounting to 2:1;

a bobbin holder for a thread bobbin provided for each planet wheel;

a thread guide eyelet supported by each planet wheel;

each said thread guide eyelet being arranged eccentrically with respect to the axis of rotation of the related planet wheel;

said thread guide eyelets being arranged in spaced relationship from one another and when at their greatest spacing from one another being situated in a plane which essentially extends through a central axis of said planet wheels; and said bobbin holders being fixedly arranged on a part of said supporting means for said planet wheels.

2. The apparatus as defined in claim 1, wherein:

said part supporting the planet wheels comprises a drivable supporting disk;

said supporting disk having opposite sides;

said planet wheels and said bobbin holders being arranged at respective different ones of said opposite sides of said supporting disk.

3. The apparatus as defined in claim 2, wherein:

said means supporting each of said planet wheels further includes a respective hub rotatably mounted on said supporting disk;

each of said hubs being provided with a continuous longitudinal bore through which there can be guided a thread between its associated thread bobbin and the related thread guide eyelet.

4. The apparatus as defined in claim 3, further including:

a pivotable arm operatively associated with each bobbin holder;

means for pivotably mounting each said arm;

means for exerting a spring force at each said pivotable arm;

the thread of the related bobbin holder being guided over the associated pivotable arm;

each said pivotable arm, depending on whether its associated thread is broken or intact, assuming various pivoted positions.

5. The apparatus as defined in claim 1, wherein:

each said thread guide eyelet rotating about the axis of rotation of the related planet wheel whereas each bobbin holder assuming a fixed spatial position relative to the related axis of rotation.

6. An apparatus for forming leno selvedges in weaving machines, comprising:

a stationary sun wheel having an axis;

two diametrically arranged planet wheels cooperating with said sun wheel;

each of said diametrically arranged planet wheels having an axis of rotation;

means for operatively coacting said two planet wheels with said sun wheel;

means supporting said planet wheels to be rotatable about their own axis in a direction opposite to their direction of rotation about the axis of the sun wheel;

means for driving said planet wheels about the axis of the sun wheel and about their own respective axis of rotation;

the transmission ratio between the sun wheel and the planet wheels amounting to 2:1;

a bobbin holder for a thread bobbin provided for each planet wheel;

a thread guide eyelet supported by each planet wheel;

each said thread guide eyelet being arranged eccentrically with respect to the axis of rotation of the related planet wheel;

said thread guide eyelets being arranged in spaced relationship from one another and when at their greatest spacing from one another being situated in a plane which essentially extends through a central axis of said planet wheels;

said bobbin holders being fixedly arranged on a part of said supporting means for said planet wheels;

said part supporting the planet wheels comprises a drivable supporting disk;

said supporting disk having opposite sides;

said planet wheels and said bobbin holders being arranged at respective different ones of said opposite sides of said supporting disk;

said means supporting each of said planet wheels further includes a respective hub rotatably mounted on said supporting disk;

each of said hubs being provided with a continuous longitudinal bore through which there can be guided a thread between its associated thread bobbin and the related thread guide eyelet;

a pivotable arm operatively associated with each bobbin holder;

means for pivotably mounting each said arm;

means for exerting a spring force at each said pivotable arm;

the thread of the related bobbin holder being guided over the associated pivotable arm;

each said pivotable arm, depending on whether its associated thread is broken or intact, assuming various pivoted positions;

switch means responsive to a given pivoted position of each of the pivotable arms indicative of a broken thread;

a fixed supporting element at which there is mounted said switch means;

said switch means being operated by the pivotable arms whenever one of said pivotable arms assumes said pivoted position indicative of a broken thread.

7. The apparatus as defined in claim 6, wherein:

said switch means comprises a proximity switch.

8. An apparatus for forming leno selvedges in weaving machines, comprising:

a stationary sun wheel having an axis;

two diametrically arranged planet wheels cooperating with said sun wheel;

each of said diametrically arranged planet wheels having an axis of rotation;

means for operatively connecting said two planet wheels with said sun wheel;

means supporting said planet wheels to be rotatable about their own axis in a direction opposite to their direction of rotation about the axis of the sun wheel;

means for driving said planet wheels about the axis of the sun wheel and about their own respective axis of rotation;

a bobbin holder for a thread bobbin provided for each planet wheel;

a thread guide eyelet mounted at each planet wheel; and said supporting means for said planet wheels including structure at which there are integrally carried said bobbin holders.

* * * * *